United States Patent [19]

Ludman et al.

[11] Patent Number: 4,580,301

[45] Date of Patent: Apr. 8, 1986

[54] MATTRESS FOR SUPPORTING THE HUMAN BODY

[75] Inventors: Walter R. Ludman, Swansea, Wales; Peter T. Lowthian, Oxhey; John T. Scales, Stanmore, both of England

[73] Assignee: Courtaulds PLC, London, United Kingdom

[21] Appl. No.: 553,188

[22] Filed: Nov. 18, 1983

[30] Foreign Application Priority Data

Nov. 19, 1982 [GB] United Kingdom ..... 8233065

[51] Int. Cl.[4] ..... A47C 27/15

[52] U.S. Cl. ..... 5/464; 5/468; 5/481

[58] Field of Search ..... 5/468, 481, 464, 423, 5/469

[56] References Cited

U.S. PATENT DOCUMENTS

| | | | |
|---|---|---|---|
| 1,142,876 | 6/1915 | Davis et al. . | |
| 2,619,659 | 12/1952 | Futterknecht | 5/481 |
| 2,750,606 | 6/1956 | Freedlander et al. . | |
| 2,982,976 | 5/1961 | Ferolito . | |
| 3,266,064 | 8/1966 | Figman | 5/469 |
| 3,278,955 | 10/1966 | Freedlander et al. | 5/464 |
| 3,521,311 | 7/1970 | Cohen . | |
| 3,757,366 | 9/1973 | Sacher | 5/469 |
| 4,407,031 | 10/1983 | Michiels | 5/481 |

FOREIGN PATENT DOCUMENTS

| | | | |
|---|---|---|---|
| 557004 | 5/1957 | Belgium | 5/464 |
| 2210095 | 4/1976 | Fed. Rep. of Germany . | |
| 2701798 | 7/1978 | Fed. Rep. of Germany | 5/468 |
| 2930750 | 2/1981 | Fed. Rep. of Germany | 5/468 |
| 3017379 | 11/1981 | Fed. Rep. of Germany | 5/468 |
| 1372493 | 10/1964 | France | 5/481 |
| 488416 | 12/1953 | Italy | 5/468 |
| 81/02384 | 9/1981 | World Intel. Prop. O. | 5/464 |
| 772026 | 5/1957 | United Kingdom | 5/481 |
| 863343 | 4/1961 | United Kingdom . | |
| 1035073 | 7/1966 | United Kingdom | 5/468 |
| 1163928 | 9/1969 | United Kingdom | 5/481 |
| 1241486 | 8/1971 | United Kingdom . | |
| 1310373 | 4/1973 | United Kingdom | 5/481 |
| 1412841 | 9/1975 | United Kingdom . | |
| 1440193 | 6/1976 | United Kingdom . | |
| 1445561 | 8/1976 | United Kingdom . | |
| 1532219 | 9/1978 | United Kingdom . | |
| 1559851 | 1/1980 | United Kingdom . | |
| 2044091 | 10/1980 | United Kingdom . | |

*Primary Examiner*—Alexander Grosz

*Attorney, Agent, or Firm*—Howson and Howson

[57] ABSTRACT

A mattress for supporting the human body, which is especially useful in hospitals or for home nursing of sick persons, comprises a body of open-cell foamed synthetic plastics material, with air passages extending up through a central region of the body. These air passages are open through the base of the central region of the mattress. The body of the mattress may comprise a base layer of foamed synthetic plastics material extending from head to foot of the mattress, and supporting elements in head and foot regions of the mattress located on this base layer. Each of these supporting elements may comprise foamed synthetic plastics material which is denser and less readily compressed than foam material in a central region of the mattress.

4 Claims, 3 Drawing Figures

Figure 3:
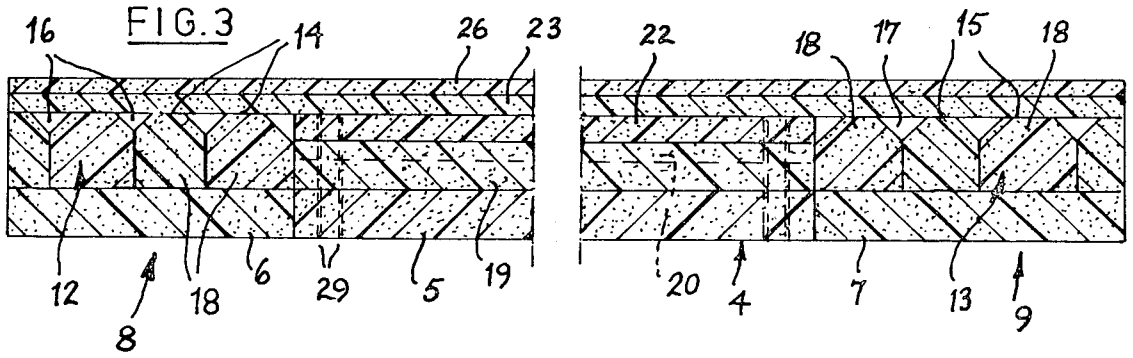

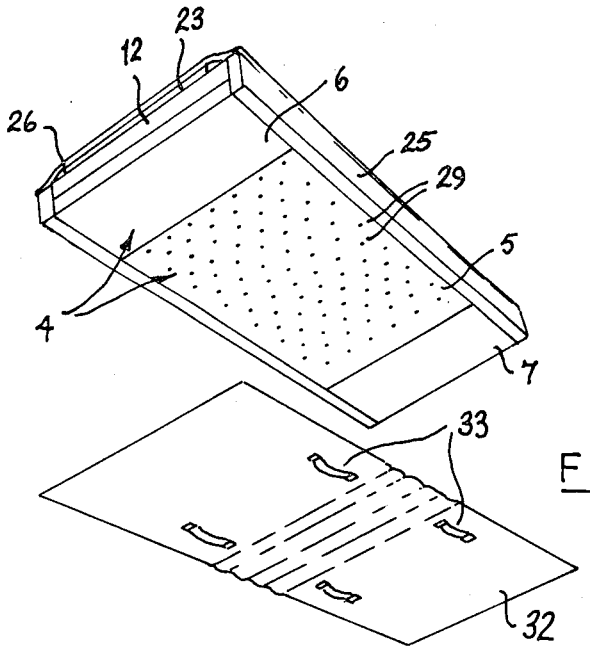
FIG. 1
FIG. 2
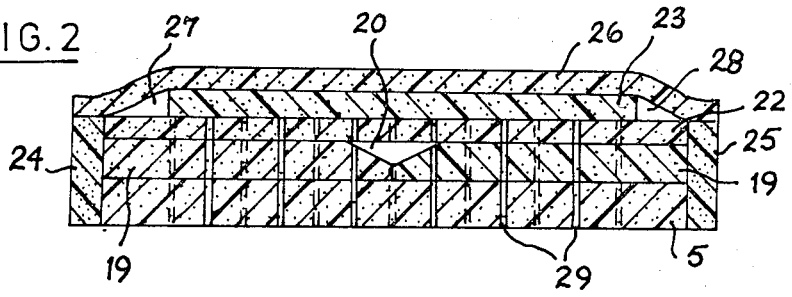

MATTRESS FOR SUPPORTING THE HUMAN BODY

This invention relates to mattresses for supporting the human body and is concerned with a mattress made of foamed synthetic plastics material having a construction making it especially useful in hospitals or for home nursing of sick persons, particularly for nursing patients confined to bed for long periods in which situation it is expected to contribute to a reduction in the incidence of bed sores.

According to one aspect of the invention, a mattress is made of open-cell foamed synthetic plastics material having air passages extending up through a central region of the mattress and open through the base of said central region. There may also be at least one air passage through the mattress communicating with said central region and open to a side or an end of the mattress and the central region of the mattress may contain foam which is less dense and more easily compressible than foam in the head and foot regions of the mattress.

In this aspect of the invention, the mattress may comprise a main body of foamed synthetic plastics material, a foamed synthetic plastics supporting layer on the upper surface of said main body and extending at least substantially the full length of the mattress but which is narrower than said main body, and a foamed synthetic plastics covering layer at least substantially co-extensive with the upper surface of said main body and covering said supporting layer.

Thus when a load is placed on the mattress, the covering layer is not immediately depressed and placed under tension, but because of its initial, dome-shaped configuration over the supporting layer, is first depressed to a relaxed condition before increasing load will further depress and tension it.

According to another aspect of the invention, a mattress comprises a main body of foamed synthetic plastics material including a base layer of foamed synthetic plastics material extending from head to foot of the mattress and supporting elements in head and foot regions of the mattress located upon said base layer, each of said supporting elements comprising foamed synthetic plastics material which is denser and less readily compressed than foam material in a central region of the mattress.

The upper surface of each of said supporting elements may contain a number of grooves extending in the direction across the mattress, and a layer of foamed synthetic plastics material may extend over the supporting elements. This latter layer may comprise foamed material which is less dense and more readily compressed than foamed material in a lower layer of the mattress.

The invention will be further described, by way of example, with reference to the accompanying drawings in which:

FIG. 1 is a perspective view from below of a mattress according to the invention showing a backing removed from the mattress, FIG. 2 is a cross-section through the mattress of FIG. 1, and FIG. 3 is a longitudinal section through the mattress of FIG. 1.

The mattress shown in the drawings is made of open-cell foamed synthetic plastics material. Polyether foams of several different densities are used in this example of the present invention.

The mattress comprises a base layer 4 made up of a block 5 of foam in a central region of the mattress and blocks 6 and 7 of foam in head and foot regions 8 and 9 of the mattress. Upon the base layer 4 in the head and foot regions 8 and 9 are located identical supporting elements 12 and 13 each having an upper surface 14 or 15 containing a number of grooves 16 or 17 extending in the direction across the mattress. In the present example, each groove 16 or 17 is 3 cm deep and 6 cm wide at its widest, the thickness of the element 12 or 13 being 6 cm. The sides of each groove form an angle in the range 20° to 70° with the horizontal, preferably 45° (in FIG. 3), and the grooves are spaced at 10 cm centres. Each supporting element 12 or 13 is built up of four polyhedral blocks 18 each having at least one chamfered edge to form the grooves 16 or 17.

In the central region of the mattress, there rests upon the base layer 4, two blocks 19 of foam chamfered along their adjacent upper edges to form a V-shaped groove 20 which extends through the central region of the mattress. Upon the blocks 19 rests a thinner block 22 of foam. Upon the upper surfaces 14 and 15 of the supporting elements 12 and 13 and upon the upper surface of the foam block 22 is located a piece 23 of foam constituting a supporting layer extending the full length of the mattress but which is narrower than the main body of the mattress comprising the base layer 4, the supporting elements 12 and 13 and the foam blocks 19 and 22.

Along each side of the main body of the mattress runs a foam side wall 24 or 25 extending from the base of the mattress to the upper surfaces 14 and 15 of the supporting elements 12 and 13 and the upper surface of the foam block 22. A foam covering layer 26 covers the whole of the main body of the mattress and the side walls 24 and 25 and, because the piece 23 of foam is narrower than the main body of the mattress, the covering layer 26 is in contact with the upper surfaces of the side walls 24 and 25 and in cross-section adopts a dome-shaped configuration (FIG. 2). This dome-shaped configuration of the covering layer 26 leaves channels 27 and 28, triangular in cross-section, which extend the full length of the mattress, and are open at each end of the mattress. Each channel 27 or 28 is delimited by an edge of the piece 23 of foam, the covering layer 26 and an edge region of the foam block 22.

Through the foam blocks 5, 19 and 22 there is drilled an array of circular section holes 29 each 1.5 cm in diameter. The holes 29 are arranged in rows extending in the length direction of the mattress spaced 5.20 cm apart and in columns extending across the mattress spaced 8.95 cm apart. The holes in adjacent rows and columns are staggered in relation to one another resulting in there being 7 columns of holes with 7 holes in each column and 7 columns of holes with 6 holes in each column making 91 holes in all in the present mattress.

On the underside of the mattress is a backing 32 of woven cotton material treated to render it fire resistant and shown detached from the mattress in FIG. 1. The backing is secured by adhesive to the underside of the mattress but a central corrugated portion of the backing is secured to the mattress only along the lines of the troughs of the corrugations to allow the mattress to bend easily transforming its upper surface into a concave arc and its lower surface into a convex one.

Carrying handles 33 are secured to the backing. The mattress will normally be used with a fire resistant stretch cover of textile material enclosing the upper surface and sides and a cover made of a stretchable synthetic plastics sheet material permeable to water vapour but impermeable to liquid water covering the upper surface and sides on top of the textile cover. Since the mattress is made of open-cell foamed material, air and water vapour can permeate through the foam. The backing 32 is water vapour porous and the holes 29, open through the base of the central region of the mattress, constitute air passages extending up from the base through the central region and allow movement of water vapour from the mattress out through the base. As will be explained in more detail later, the central region of the mattress is made of more compressible, and thus generally less dense, foam than the head and foot regions of the mattress and carries the heavier portions of a patient using the mattress. It is believed that this may contribute to a "pumping action" promoting flow of air out of and into the material of the mattress and removal of water vapour from the region of the patient.

The channels 27 and 28 constitute air passages through the mattress communicating with the central region and open to the ends of the mattress. These channels also permit movement of air in and out of the mattress and it is believed promote the reduction of humidity in the immediate environment of the patient. Air passages through the mattress may also be provided by channels cut through the foam material in the head, foot or central regions of the mattress and open to the sides thereof. Of course the channels 27 and 28 in communicating with the central region of the mattress pass through the head and foot regions of the mattress and are in communication therewith.

The dome shape, as shown in section (FIG. 2), of the covering layer 26 ensures that when a patient places his weight on the mattress, the covering layer 26 is not immediately depressed and placed under tension. Initial application of a load straightens out the dome shape and reduces tension in the covering layer and only those loads great enough to depress the piece 23 of foam at the part of the mattress concerned, will produce tension in the covering layer 26, which will then also be depressed so as to present upwardly a concave, as opposed to the initial convex, configuration. It is believed that this arrangement, producing a softer mattress with greater extensibility in the upper layers, can be advantageous in reducing the incidence of bed sores, as can a reduction in the humidity of the patient's environment.

The densities and hardness grades of the foam materials used in the mattress described above are given in the following Table:

TABLE

| Foam Material | Density kg/M$^3$ | Hardness Grade B.S. 3379:76 |
|---|---|---|
| Block 5 | 48.0–51.0 | 130 |
| Blocks 6 and 7 and side walls 24 and 25 | 80 | (Hard chipfoam) |
| Blocks 18 and 19 | 34.5–37.0 | 130 |
| Block 22 and piece 23. | 30.5–32.5 | 100 |
| Covering layer 26 | 32.0–36.0 | 70 or 100. |

The foam materials used are polyurethanes of the polyether type. The foam material of the covering layer 26 is a highly resilient grade of foam.

It will be seen from the above information that the head and foot regions of the mattress include foam material (blocks 6, 7 and 18) which is denser and thus less readily compresses than foam material in the central region of the mattress (blocks 5 and 22). In particular, the supporting elements 12 and 13 in the head and foot regions and comprising foam blocks 18 are of denser material than the foam block 22 in the central region. The covering layer 26 and the piece 23 of foam are of more compressible material than lower elements of the mattress constituted by the blocks 5, 6, 7, 18 and 19, and in general will have a lower density.

The groove 20 formed by the foam blocks 19 extends through the central region of the mattress. It is 8 cm wide at its widest point and 1.4 cm deep. The angle of inclination of each side boundary face of the groove to the horizontal in FIG. 2 is in the range 15° to 35°, preferably 20°. The purpose of the groove is to reduce the pressure on the spine and sacrum of the patient by making the mattress more compressible in the region of the groove.

The grooves 16 and 17 reduce the pressure acting on the patient's heels and shoulder region and in addition whichever of them are in the foot region of the mattress provide a purchase for the under surface of a patient's heels when the patient wishes to push himself towards the head region of the mattress, thus reducing the sheer stresses acting on the regions at the back of the patient's heels. Of course the foam material overlying the grooves 16, 17 and 20 must be sufficiently compressible to make the presence of the grooves effectively sensible at the upper surface of the mattress.

The mattress construction is such that it is symmetrical about a cross-sectional plane through its centre and thus either end may be used as the head or foot of the mattress. In the present mattress the covering layer 26 and the foam piece 23 are each 2 cm thick, the block 22 is 1.5 cm thick and the block 19 is 4.5 cm thick. The blocks 18 are thus 6.0 cm thick and they are 10 cm wide (as seen in FIG. 3), except for the end blocks 18 which are 5 cm wide. The blocks 5, 6 and 7 are each 4.5 cm thick and the overall dimensions of the mattress are 200 cm by 87 cm by 14.5 cm.

The construction of the mattress described allows the mattress to conform closely to a contouring bed frame in that parts of the upper surface of the mattress may become convex in shape without adversely affecting its efficiency as a support.

The mattress may be cut into sections along vertical planes to form a number of "biscuits". An individual biscuit can then be removed to give access to a patient lying on the remaining biscuits.

What is claimed is:

1. A mattress comprising (a) a body of open-cell foamed synthetic plastics material, (b) air passages extending up through a central region of said body and open through a base of said central region, (c) two enclosed air passages extending the full length of said mattress each in an upper side edge region thereof and open to both ends of the mattress, (d) said mattress including head and foot regions, containing supporting elements comprising foamed synthetic plastics material which is denser and less easily compressible than foamed material in said central region of the mattress, (e) a foamed synthetic plastics supporting layer on the upper surface of said main body and extending at least substantially the full length of the mattress but which is narrower than said main body, (f) a foamed synthetic plastics covering layer at least substantially co-extensive with the upper surface of said main body and covering said supporting layer, and wherein (g) each of said supporting elements has an upper surface containing a number of grooves extending in the direction across the mattress.

2. A mattress as claimed in claim 1, wherein said layer extending over the supporting elements comprises foamed material which is less dense and more readily compressed than foamed material in a lower layer of the mattress.

3. A mattress as claimed in claim 1 wherein said two enclosed air passages extending the full length of said mattress are delimited by the upper surface of said main body of the mattress, said covering layer and said supporting layer.

4. A mattress comprising (a) a main body of open-cell foamed synthetic plastics material, (b) air passages extending up through a central region of said main body and open through the base of said central region, (c) two enclosed air passages extending the full length of the mattress, each in an upper side edge region thereof and each open to both ends of the mattress, (d) a foamed synthetic plastics supporting layer on the upper surface of said main body and extending at least substantially the full length of the mattress but which is narrower than said main body, (e) a foamed synthetic plastics covering layer at least substantially co-extensive with the upper surface of said main body and covering said supporting layer, and (f) said mattress including head and foot regions, said central region of the mattress containing foam which is less dense and more easily compressible than foam in said head and foot regions of the mattress.

* * * * *